US006267272B1

(12) United States Patent
Shin

(10) Patent No.: US 6,267,272 B1
(45) Date of Patent: Jul. 31, 2001

(54) ICE CUBE OUTLET COVER ASSEMBLY FOR REFRIGERATOR

(75) Inventor: Dong-In Shin, Kwangju (KR)

(73) Assignee: Samgsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/557,210

(22) Filed: Apr. 25, 2000

(30) Foreign Application Priority Data

Sep. 3, 1999 (KR) ..... 99-18673

(51) Int. Cl.[7] ..... B67D 3/00

(52) U.S. Cl. ..... 222/505; 222/146.5; 222/515; 222/517

(58) Field of Search ..... 222/146.6, 505, 222/511, 515, 517

(56) References Cited

U.S. PATENT DOCUMENTS 3,942,334 * 3/1976 Pink ..... 62/266
4,090,641 * 5/1978 Lindenschmidt ..... 222/70
4,555,049 * 11/1985 Mawby et al. ..... 222/517
5,077,985 * 1/1992 Buchser et al. ..... 62/344
5,437,391 * 8/1995 Landers et al. ..... 222/1
6,135,173 * 10/2000 Lee et al. ..... 141/361

FOREIGN PATENT DOCUMENTS 8-152241 6/1996 (JP) .
9-145212 6/1997 (JP) .

* cited by examiner

*Primary Examiner*—Kevin Shaver
*Assistant Examiner*—Frederick C Nicolas
(74) *Attorney, Agent, or Firm*—Larson & Taylor PLC

(57) ABSTRACT

An ice cube outlet cover assembly for a refrigerator includes an improved cover (40) and a cover actuating lever (50) for providing opening and closing of an ice cube outlet (22). The cover (40) and lever (50) include a hinge portion (49) and hinge member (53) which are made of a flexible material and include respective hinge shafts (42 and 53*a*) for rotatably supporting the associated cover (40) and lever (50). Shaft supporting members (43 and 54) are provided on the inner wall (25*a*) of an access opening (25) in which the hinge shafts (42 and 53*a*) are easily fitted by bending and releasing the hinge portion (49) and hinge member (53). The hinge portion (49) and hinge member (53) include respective spring supporting bars (44 and 53*b*) on which springs (45 and 47) are mounted to return the cover (40) and lever (50), respectively, to the original positions thereof when an ice dispensing operation is completed.

16 Claims, 7 Drawing Sheets

ICE CUBE OUTLET COVER ASSEMBLY FOR REFRIGERATOR

BACKGROUND OF THE INVENTION

1. Field of the Invention

The present invention relates to an ice cube outlet cover assembly for a refrigerator and more particularly, to a cover assembly having an improved cover and cover actuating lever for opening and closing such an ice cube outlet.

2. Description of the Prior Art

In general, a refrigerator is an appliance which is utilized to keep various foods in a fresh state by supplying cool air generated from an evaporator to food storing compartments. Recently, there has been an increasing demand for large-sized refrigerators with expanded food storage space so as to reduce food shopping and make life more convenient.

Most domestic refrigerators of large size are of a side-by-side type which include a vertical partition whereby the cabinet forming the framework of the refrigerator is divided lengthwise into refrigerating and freezing compartments. Accordingly, the doors which are mounted on the front of each compartment are also arranged side by side. In the freezing compartment of such a large-sized refrigerator, there is provided an automatic ice making device for the convenience of the users, and in the freezing compartment door, there is provided an ice cube dispensing device which enables the user to obtain ice cubes directly from the outside of the refrigerator without opening of the door. Ice cubes made by the automatic ice making device are stored in an ice cube storing vessel which is located in the freezing compartment adjacent to the ice cube outlet which is provided in the freezing compartment door. When a user operates the ice cube dispensing device, the ice cubes stored in the ice cube storing vessel are discharged out through the ice cube outlet.

FIG. 1 illustrates an example of a conventional ice cube outlet cover assembly. As illustrated, the conventional ice cube outlet cover assembly is disposed in an access opening 8 which is formed on the freezing compartment door so as to receive ice cubes, and includes a cover 2 which is mounted over and around an ice cube outlet 1 and a cover actuating lever 3 which causes the cover 2 to open and close the ice cube outlet 1. In front of the cover actuating lever 3 is mounted a guide member 4 for guiding the ice cubes from the ice cube outlet 1 to a receptacle (e.g., glass or cup) positioned there.

The cover 2 is mounted in such a manner that it is able to swing forward around the upper end thereof on the ice cube outlet 1. For this purpose, there are provided connecting members 2*a* which extend upwardly from both side ends of the cover 2 and a bracket 5 on the ice cube outlet 1 for rotatably supporting the connecting members 2*a*. At a lower portion of each connecting member 2*a* is provided a projection 2*c* extending outwardly therefrom. The bracket 5 has support portions 5*b* at both lateral ends, and is fixed to an inner wall 8*a* forming the access opening 8 by screws 5*a*. Holes 2*b* and 5*c* are formed at upper ends of the connecting members 2*a*, and the support portions 5*b* of the bracket 5, respectively. A hinge shaft 6 is inserted into the holes 2*b* and 5*c* so that the cover 2 is rotatably fitted to the bracket 5. A torsion coil spring 7, located on the hinge shaft 6, provides an elastic force or spring bias to the hinge shaft 6 and biases the cover 2 into a position wherein the ice cube outlet 1 is closed by the cover 2 in the normal state of the cover assembly. The coil spring 7 is disposed around the hinge shaft 6, with one end of the spring 7 supported by the bracket 5 and the other end thereof supported by the cover 2, thereby biasing the cover 2 into the normal state thereof.

The cover actuating lever 3 includes an upper actuating portion 3*a* of a semicircle shape which encloses the periphery of the cover 2 and a pushing arm 3*b* which extends downwardly from the actuating portion 3*a*. Hinge shafts 3*c* project outwardly from outer lower sides of the actuating portion 3*a*. The hinge shafts 3*c* are supported by supporting members 9 which are disposed below the ice cube outlet 1. The supporting member 9 includes a receiving element 9*a* which is fitted to the inner wall 8*a* of the access opening 8 and which has a traverse groove for receiving the hinge shaft 3*c*, and a fixing or securing element 9*b* which is fitted to the receiving element 9*a* by a screw. Thus, the cover actuating lever 3 is rotatably mounted on the supporting member 9 when the hinge shafts 3*c* are inserted into the respective receiving elements 9*a*, and then the fixing elements 9*b* are fitted to the receiving elements by screws.

Pushing bars 3*d* project inwardly from inner upper sides of the actuating portion 3*a*, and serve to push the projections 2*c* of the connecting member 2*a* to open the cover 2 when the pushing arm 3*b* of the cover actuating lever 3 is pressed.

An important disadvantage of the device of FIG. 1 is that a number of steps are required in the assembly process for the device, as follows: fitting the cover to the wall by screws; locating the connecting members of the cover in the bracket; and inserting the hinge shaft with the coil spring into the associated holes. Similarly, in order to rotatably fit the cover actuating lever below the ice cube outlet, a number of steps are required in the assembly process, as follows: attaching the receiving elements of the supporting member to the inner wall of the access opening; inserting the hinge shafts of the cover actuating lever into the respective receiving elements; and securing or fitting the fixing elements to the receiving elements by screws. This complexity in the assembly process is the result of the complexity of the conventional cover device itself which is, as is evident from the foregoing, comprised of a relatively large number of components and is of a complicated construction. Therefore, the conventional cover device of FIG. 1 takes a relatively long time to assemble and the associated manufacturing costs thereof are high.

SUMMARY OF THE INVENTION

The present invention is concerned with overcoming the problems discussed above, and in this regard, an object of the present invention is to provide an ice cube outlet cover assembly for a refrigerator which includes an improved cover and cover actuating lever for opening and closing the ice cube outlet, and which is of construction that is easy to assemble and disassemble and is of lower manufacturing cost.

In order to achieve this object and other objects, an ice cube outlet cover assembly for a refrigerator is provided which is adapted to be received in an access opening in which an ice cube outlet is formed and which comprises:

a cover for the ice cube outlet including a cover portion for covering the ice cube outlet and a hinge portion for hingedly mounting the cover portion in the access opening, and a cover actuating lever for moving t he cover between a first position wherein the ice cube outlet is open and a second position wherein the ice cube outlet is closed, the hinge portion including connecting members extending upwardly from both sides of the cover portion, cover hinge shafts extending outwardly from upper ends of respective ones the connecting members, a spring supporting bar extending inwardly from one of the connecting members, a cover spring mounted on the spring supporting bar for exerting a biasing force on said cover portion, and support projections extending outwardly from lower ends of the respective ones of the connecting members.

Preferably, the ice cube outlet cover assembly further comprises shaft supporting members disposed above the ice cube outlet for rotatably supporting respective ones of the cover hinge shafts. Advantageously, the connecting members are of sufficient flexibility to enable the cover hinge shafts to be mounted in said shaft supporting members by deflection and release of the connecting members.

The spring supporting bar is preferably disposed on a common axis with the cover hinge shafts. Preferably, an end stop is disposed at a distal end of the spring supporting bar to prevent removal of the cover spring therefrom.

The cover actuating lever preferably includes an actuating portion having pushing bars for pushing the projections forwardly to open the ice cube outlet, a user operated tongue portion extending downwardly from the actuating portion, and hinge members extending downwardly from both sides of the actuating portion and including a spring supporting bar projecting inwardly therefrom and a lever hinge shaft projecting outwardly therefrom. A lever spring is preferably mounted on the spring supporting bar for returning the cover actuating lever to an initial position thereof after termination of an ice dispensing operation. Advantageously, the hinge member includes a slot for fixing one end of the lever spring therein so as to prevent removal of the lever spring. Advantageously, the spring supporting bar and lever hinge shaft are disposed on a common axis. Preferably, the shaft supporting members are disposed below the ice cube outlet so as to rotatably support respective ones of the lever hinge shafts. Advantageously, the hinge members are of sufficient flexibility to enable the lever hinge shafts to be mounted in the shaft supporting members by deflection and release of the hinge members.

Further features and advantages of the present invention will be set forth in, or apparent from, the detailed description of preferred embodiments thereof which follows.

BRIEF DESCRIPTION OF THE DRAWINGS

As indicated above, further objects and advantages of the present invention will become apparent from the following description of a preferred embodiment of the invention, taken in conjunction with the attached drawings, in which.

DETAILED DESCRIPTION OF THE PREFERRED EMBODIMENTS

A preferred embodiment of the present invention will now be described in detail with reference to the accompanying drawings.

Figure 1:
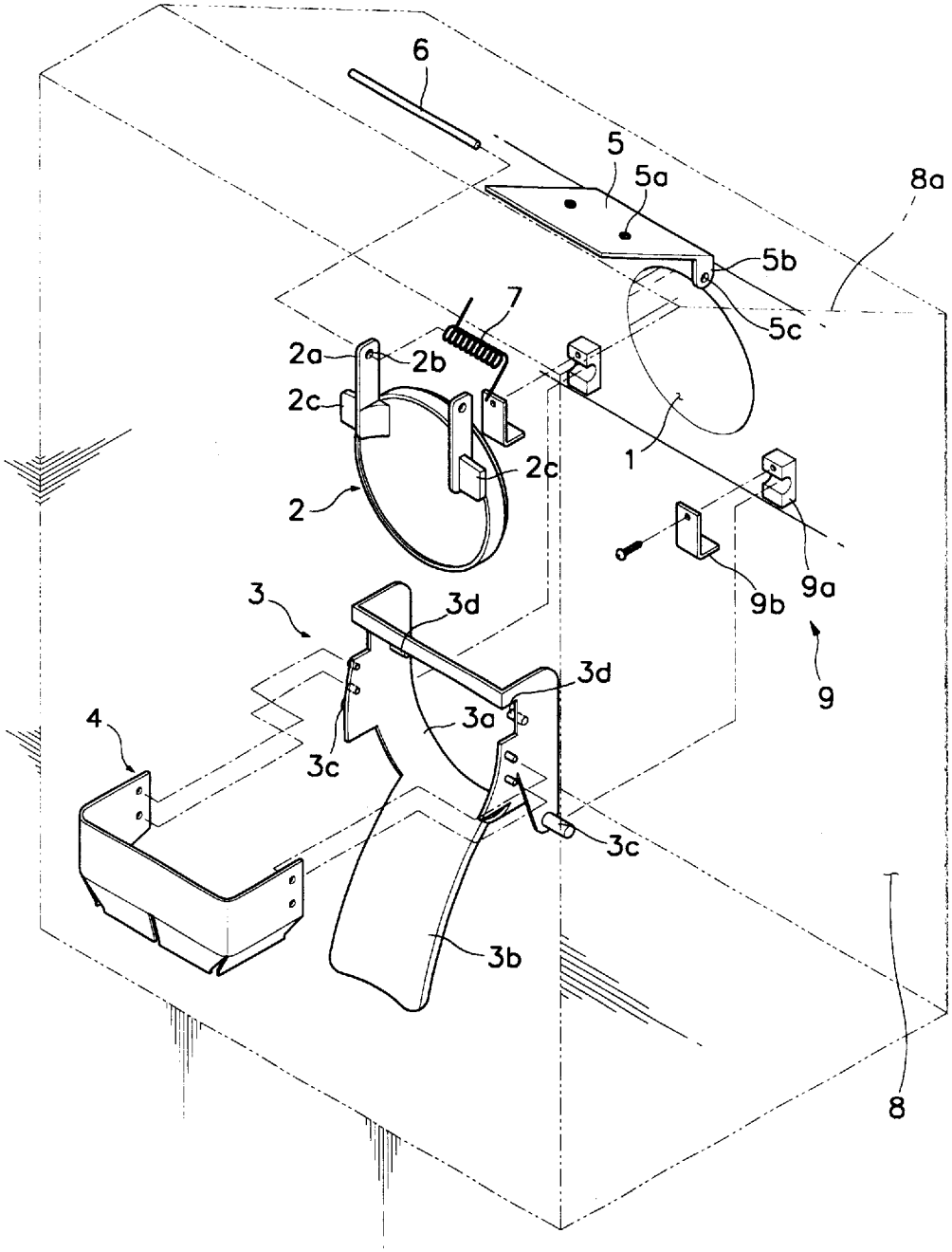
FIG. 1 (PRIOR ART)
FIG. 1 is, as discussed above, an exploded perspective view of a prior art ice cube outlet cover assembly.
Figure 2:
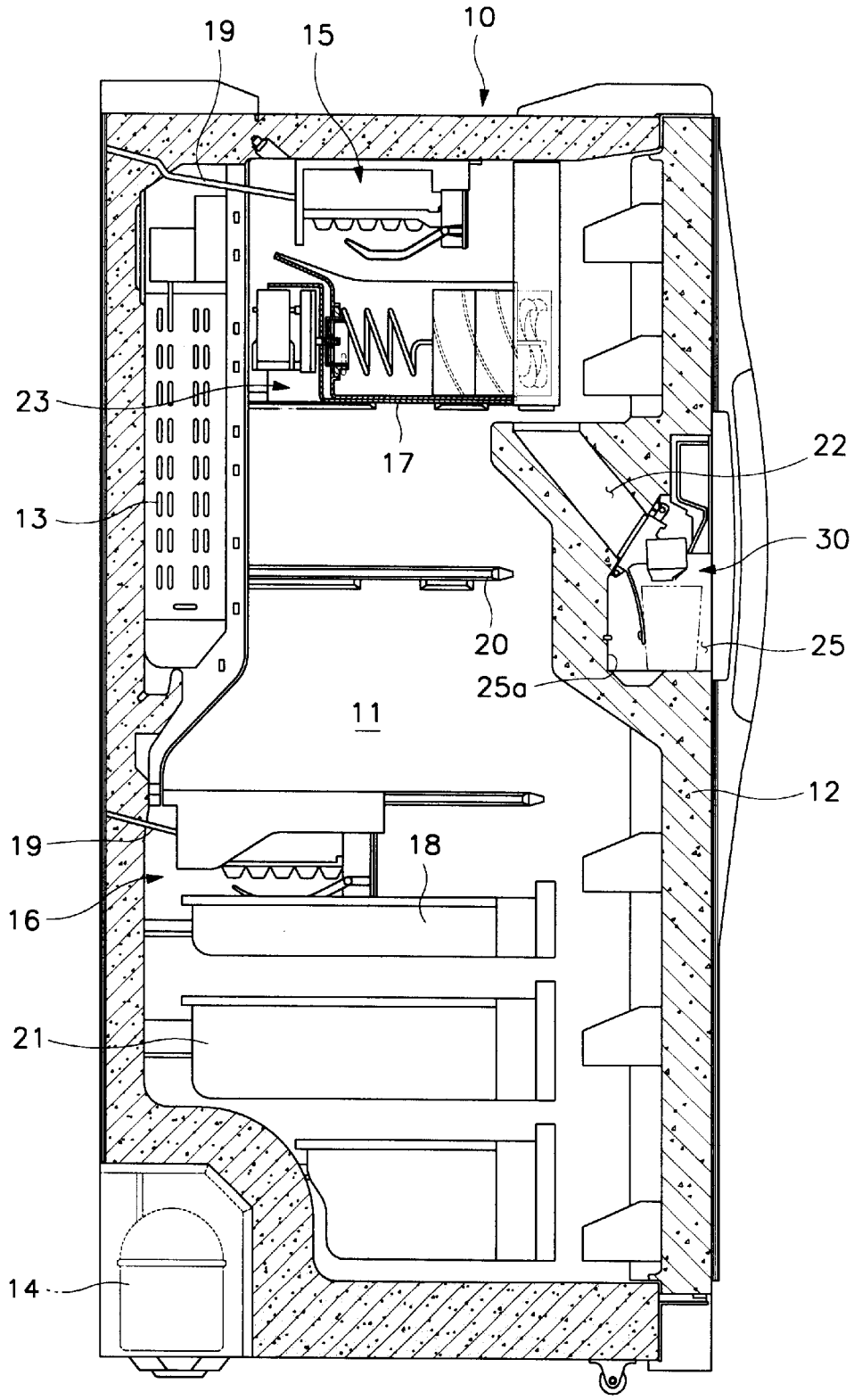
FIG. 2 is a longitudinal sectional view of a refrigerator in which the cover assembly of the present invention is incorporated.

FIG. 2 shows the construction of a freezing compartment of a side-by-side type refrigerator into which this invention is to be incorporated. The freezing compartment, which is denoted 11, is formed by partitioning a cabinet 10 into different sections, i.e., right and left sides. A freezing compartment door 12 is mounted at the front of the freezing compartment 11, and an evaporator 13 and a compressor 14 for generating cool air are mounted at a rear wall of the cabinet 10.

The refrigerator also includes a main ice making device 15, an ice cube storing receptacle or vessel 17 and an ice cube transferring device 23 at a upper portion of the freezing compartment 11, and a spare ice making device 16 and an ice cube storing receptacle or vessel 18 at a middle portion of the freezing compartment 11. Water tubes 19 are connected to the ice making devices 15 and 16 so as to directly feed water to the devices 15 and 16 from an external water supply source (not shown). Shelves 20 and freezer boxes 21 are also provided for storing frozen foods in the freezing compartment 11.

In the freezing compartment door 12, there is provided an ice cube outlet 22 which communicates with the freezing compartment 11 to form a discharge passage for ice cubes so that a user can take ice cubes out of the ice cube storing receptacle or vessel 17 even when the door 12 is closed. On the outer surface of the door 12 there is provided an access opening 25 for receiving the ice cubes discharged from the ice cube outlet 22. An ice cube outlet cover assembly 30 for opening and closing the ice cube outlet 22 is mounted in the access opening 25.

Figure 3:
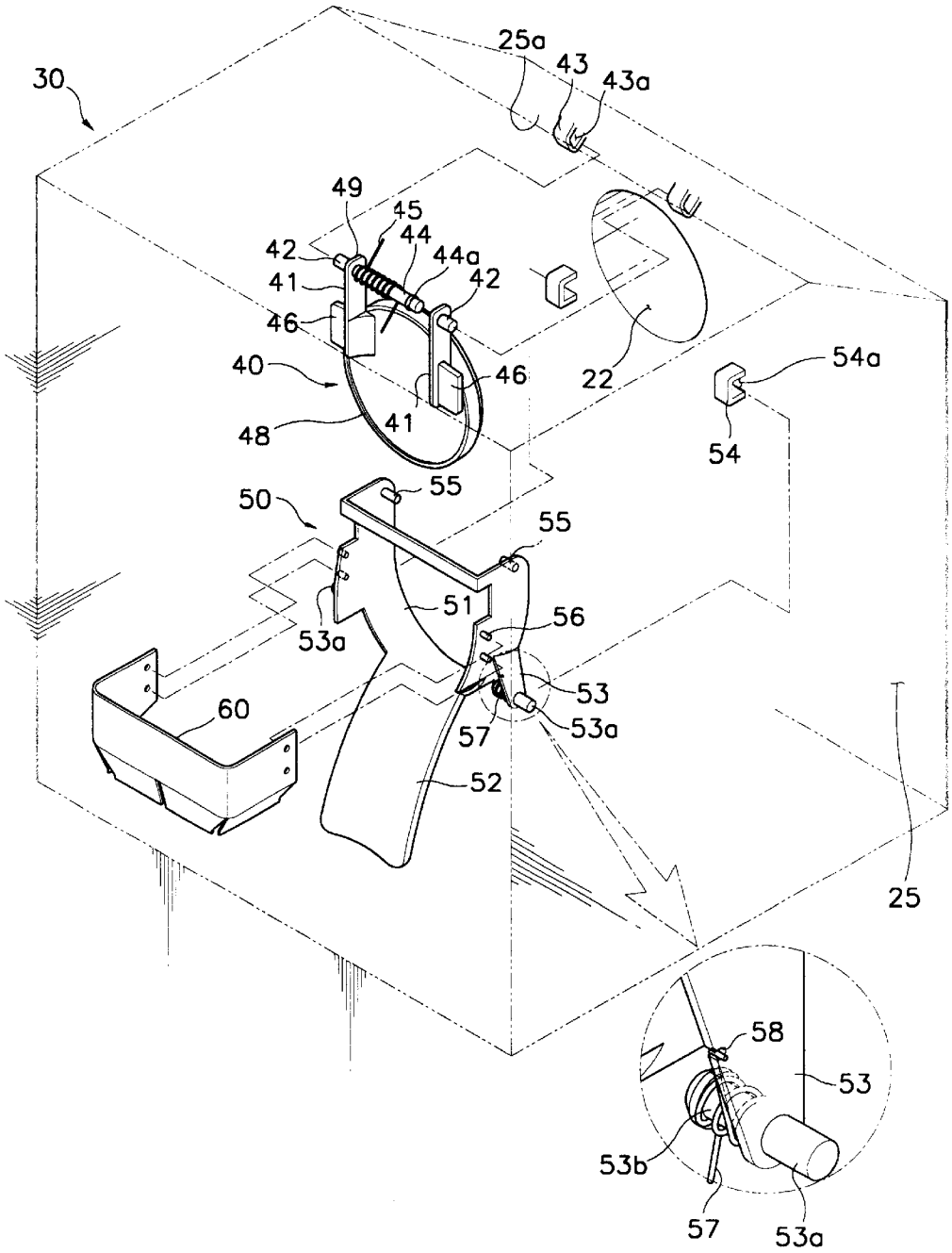
FIG. 3 is an exploded perspective view of an ice cube outlet cover assembly according to a preferred embodiment of the invention.
Figure 4:
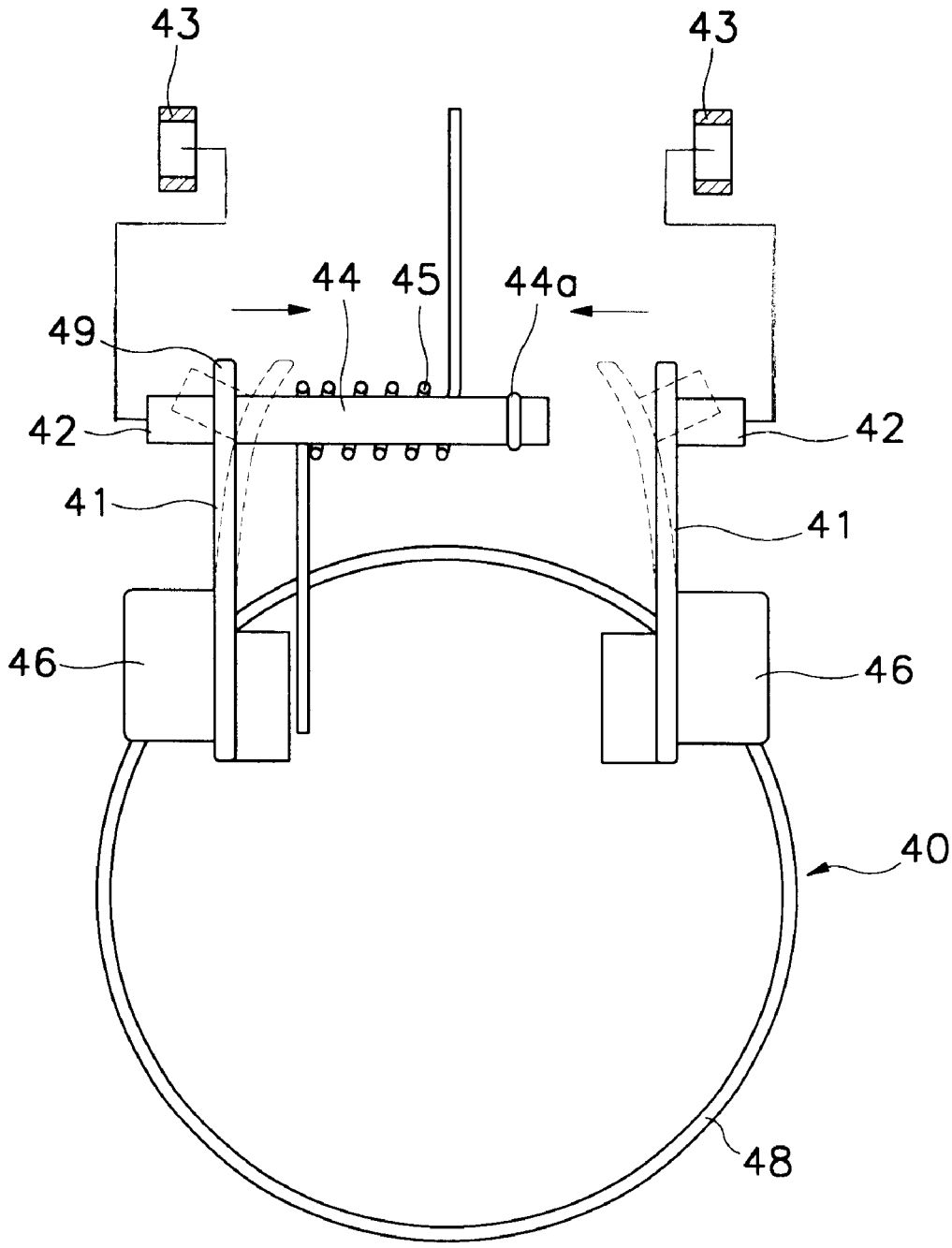
FIG. 4 is a front view of the cover shown in FIG. 3.

As indicated in FIGS. 3 and 4, which show a preferred embodiment of the ice cube outlet cover assembly 30 according to the present invention, the ice cube outlet cover assembly 30 includes a cover 40 which is rotatably mounted around the ice cube outlet 22, a cover actuating lever 50 for providing rotation of the cover 40 to open and close the ice cube outlet 22, and a guide member 60 which is mounted at the front of the cover actuating lever 50 to guide the discharged ice cubes to a receptacle (e.g., glass or cup) held by a user.

The cover 40 includes a cover portion 48 of a round shape which is a size sufficient to cover the ice cube outlet 22 and a hinge portion 49 for hingedly mounting the cover portion 48.

The hinge portion 49 includes a pair of connecting members 41 which extend upwardly from the sides of the cover portion 48, a pair of cover hinge shafts 42 which extend outwardly from upper ends of the respective connecting members 41, a spring supporting bar 44, which can extend inwardly from either of the connecting members 41 and is shown in FIGS. 3 and 4 as extending from the left side connecting member 41, and a cover spring 45 which is mounted on the spring supporting bar 44 to furnish a biasing or restoring force to the cover portion 48. At a lower portion of each connecting member 41 there is provided a projection 46 for enabling pivoting or swinging of the cover 40 in response to the operation of the cover actuating lever 50.

Figure 6:
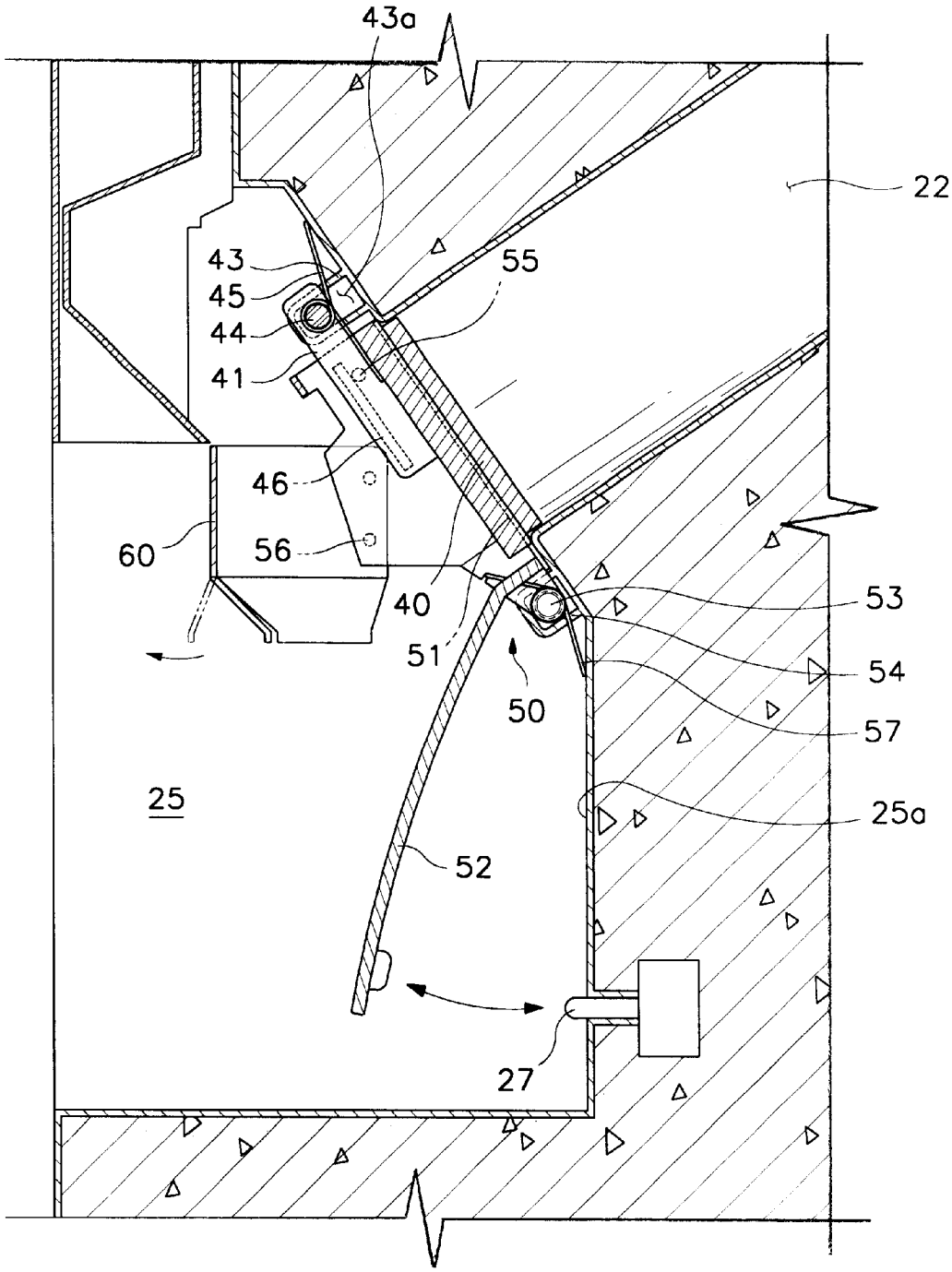
FIG. 6 is a longitudinal sectional view of an ice cube outlet cover assembly according to a preferred embodiment of the invention, showing the closed state thereof.

A pair of upper shaft supporting members 43 is provided above the ice cube outlet 22 for rotatably supporting the cover hinge shafts 42. The upper shaft supporting members 43 are spaced from each other and formed integrally with an inner wall 25*a* of the access opening 25. Members 43 each include a horizontal hinge opening hole 43*a* sized so as to receive the cover hinge shaft 42 therein. The end of the spring supporting bar 44, which extends from one (the left one in FIGS. 3 and 4) of the connecting members 41, is mounted in spaced relation to the other (right) connecting member 41 so as to form a space or gap therebetween and so that the cover spring 45 can be easily mounted on the spring supporting bar 44. A retaining element or end stop 44*a* is provided at an end portion of the spring supporting bar 44 to prevent the cover spring 45 from being removed from the spring supporting bar 44 after being mounted thereon. When the cover spring 45 is mounted on the spring supporting bar 44, one end of the cover spring 45 is supported on the inner wall 25*a* of the access opening 25 and the other end of the cover spring 45 is supported on the outer surface of the cover 40 (as shown in FIG. 6), so as to exert a biasing force on the cover 40.

The cover 40, constructed as aforementioned, can be made as a unitary, integral member by injection molding, except for the cover spring 45. The cover 40 is made of a resilient or flexible material having a suitable strength, such as ABS resin, so that the connecting members 41 can be easily bent or deflected inwardly and the cover hinge shafts 42 can be inserted into the hinge holes 43*a* of the shaft supporting members 43 and secured therein upon release of connecting members 41. The shaft supporting members 43 can be also made integrally with the inner wall 25*a* of the access opening 25 using injection molding.

The process for assembly of the cover 40 is a simple one and includes the steps of: fitting the cover spring 45 on the spring supporting bar 44; pressing or deflecting the pair of the connecting members 41 inwardly, as indicated in dashed lines in FIG. 4; and inserting the cover hinge shafts 42 into the hinge holes 43*a* of the respective shaft supporting members 43. With these simple steps, the cover 40 is mounted on the inner wall 25*a* of the access opening 25.

The cover actuating lever 50 for opening the cover 40 includes an actuating member 51 of a semicircle shape disposed at the periphery of the cover 40, a user operated tongue member 52 extending downwardly from the actuating member 51, and hinge members 53 which are formed at both sides of the actuating member 51. The hinge members 53 include a lever hinge shaft 53*a* which projects horizontally from the outer surface of the associated member 53 and a spring supporting bar 53*b* which projects horizontally from the inner surface thereof.

Below the ice cube outlet 22, shaft supporting members 54 are disposed in spaced relation to each other so as to rotatably support a respective lever hinge shaft 53*a*. Lever springs 57 are mounted on respective spring supporting bars 53*b* so as to exert a biasing force on the cover actuating lever 50. One end of the lever spring 57 is inserted into a slot formed on the associated hinge member 53 as shown in FIG. 3, while the other end of the lever spring 57 is supported on the inner wall 25*a* of the access opening 25, as shown in FIG. 6.

At an upper portion of the actuating member 51, pushing bars 55 project horizontally inwardly to push the projections 46 of the connecting members 41 forwardly, and thereby open the cover 40, when the tongue member 52 of the lever 50 is depressed or pushed. On the hinge members 53, fixing bars 56 project outwardly so as to provide rotatable support for the guide member 60 disposed at the front of the cover actuating lever 50.

As in case of the cover 40, the cover actuating lever 50, constructed as aforementioned, can be made as an integral, unitary member using injection molding, except for the lever springs 57. The cover actuating lever 50 is also made of a resilient or flexible material of a suitable strength, such as ABS resin, so that the hinge members 53 can be easily bent or deflected inwardly and the lever hinge shafts 53*a* can be readily inserted into the hinge holes 54*a* of the shaft supporting members 54 so as to be retained therein when the hinge members 53 are released. The shaft supporting members 54 can be also formed integrally with the inner wall 25*a* of the access opening 25 using injection molding.

Figure 5:
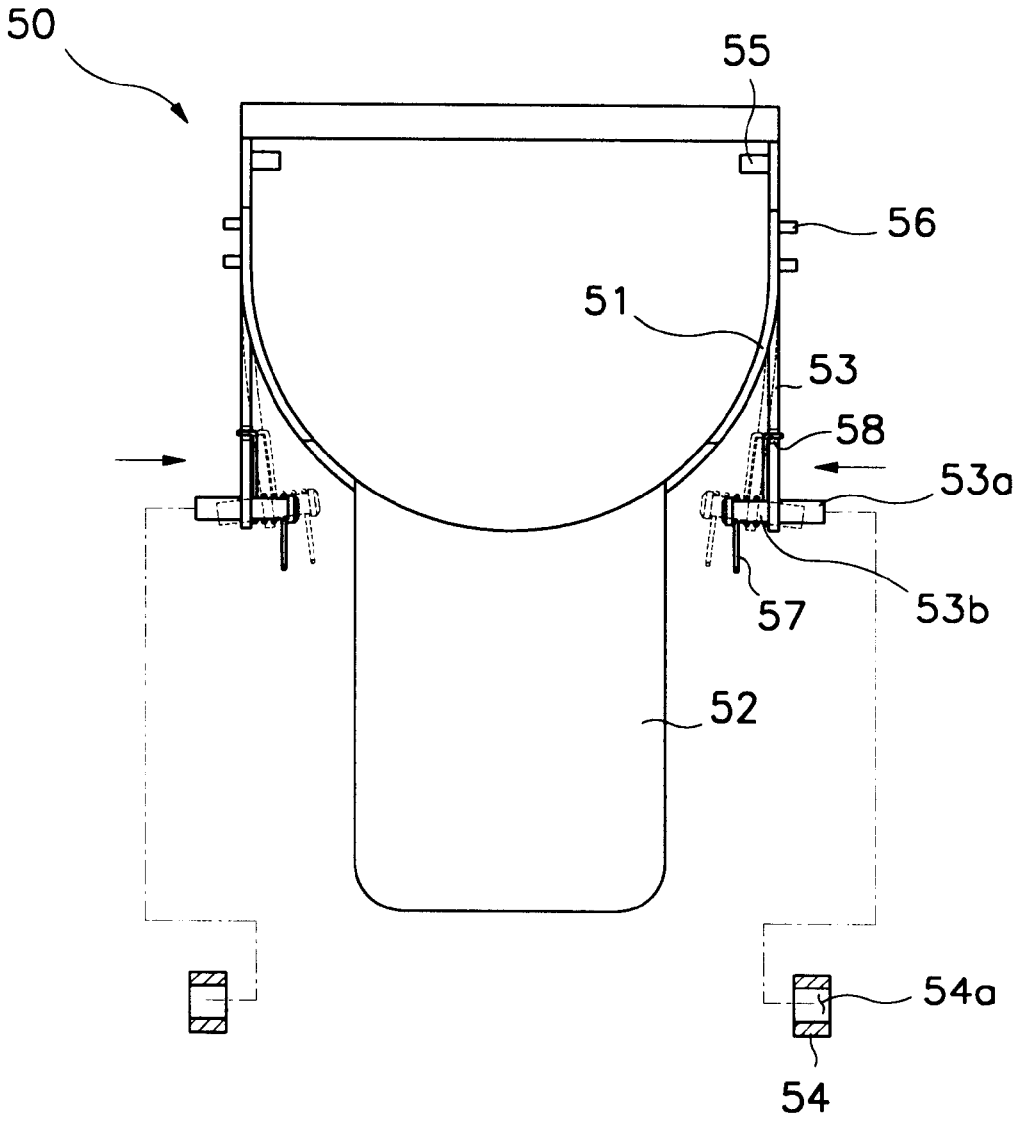
FIG. 5 is a front view of the cover actuating lever shown in FIG. 3.

The cover actuating lever 50 is assembled using simple steps, as follows: fitting the lever springs 57 on the respective spring supporting bars 53*b*; pressing the pair of the hinge members 53 inwardly as shown in dashed line in FIG. 5; and inserting the lever hinge shafts 53 into the hinge holes 54*a* of the respective shaft supporting members 54. With these few steps, the cover actuating lever 50 can be readily mounted on the inner wall 25*a* of the access opening 25.

Figure 7:
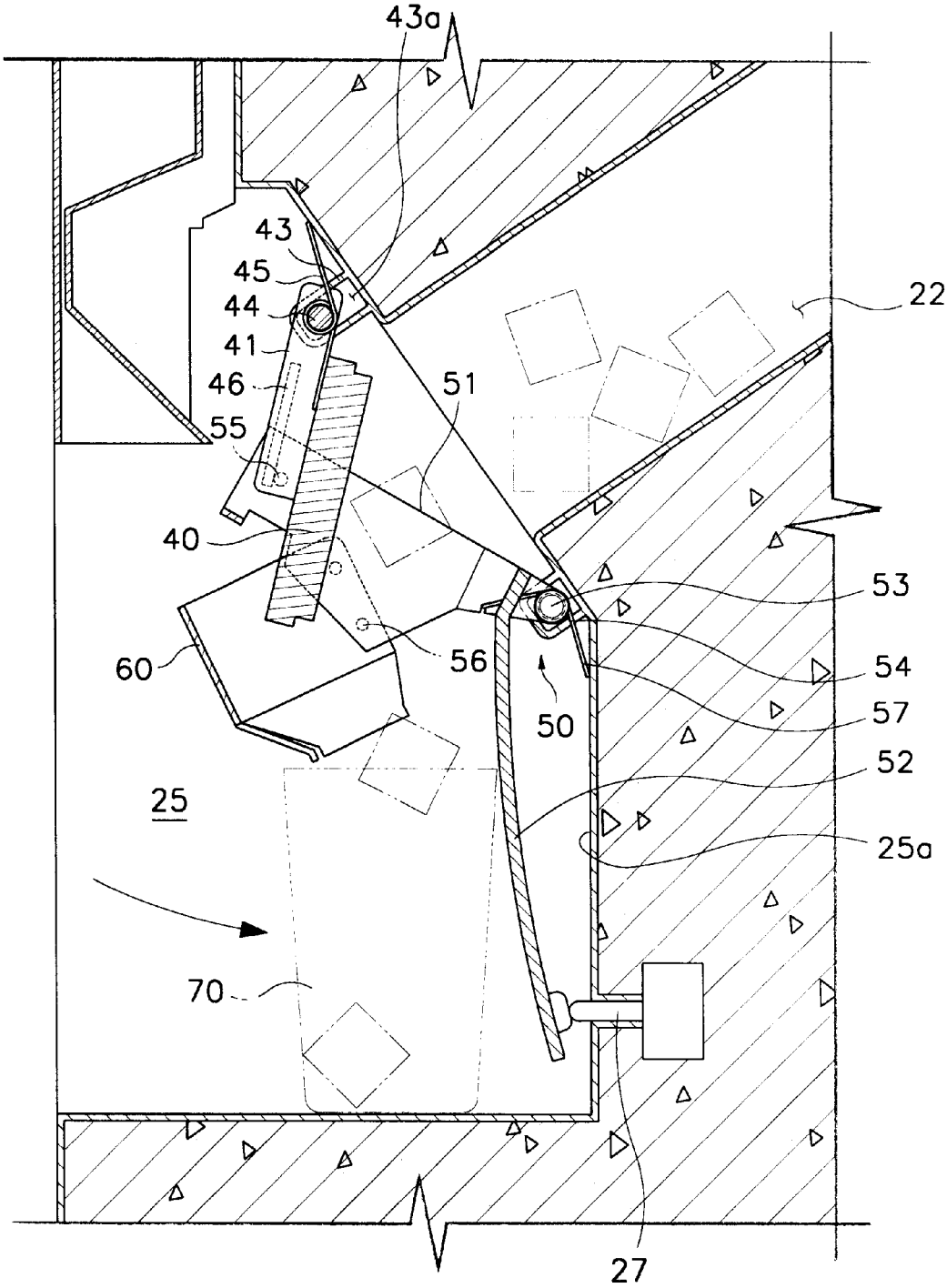
FIG. 7 is a longitudinal sectional view of an ice cube outlet cover assembly according to a preferred embodiment of the invention, showing the open state thereof.

The operation of the ice cube outlet cover assembly will be now described with reference to FIGS. 6 and 7.

As shown in FIG. 6, when the tongue portion or member 52 of the cover actuating lever 50 is not depressed, the cover 40 is maintained in the closed state wherein the ice cube outlet 22 is closed by the biasing force of the cover spring 45. In this state, when a user pushes the tongue member 52 inwardly, the cover actuating lever 50 is caused to pivot around the lever hinge shafts 53 with attendant compression of the lever spring 57, as shown in FIG. 7. By virtue of this pivoting of the cover actuating lever 50, the pushing bars 55, which are provided at a upper portion of the lever 50, push against the projections 46 provided at the connecting members 41 of the cover 40. This causes the projections to move forwardly and this movement causes the cover 40 to pivot or rotate around the cover hinge shafts 42 (see FIG. 3), with compression of the cover spring 45, thereby opening the ice cube outlet 22. At the same time, the tongue member 52 of the lever 50 depresses and actuates the operating switch 27 which is mounted in the inner wall 25*a* of the access opening 25. With the actuation of the operating switch 27, the ice cube transferring device 23 in the freezing compartment 11 is operated to transfer ice cubes to the ice cube outlet 22.

After the receptacle has been filled with a required amount of ice cubes, the user releases tongue member 52 and terminates the operation of the cover actuating lever 50 and the cover 50 is returned to the original position thereof by the biasing force of the cover spring 45 so as to close the ice cube outlet 22. At the same time, the cover actuating lever 50 is also returned to the original position by the biasing force of the lever springs 57. As a result, the ice cube outlet cover assembly is maintained in the closed position thereof wherein the ice cube outlet 22 is closed, as shown in FIG. 6. Also, release and deactivation of the operating switch 27, terminates the operation of the ice cube transferring device 23 so as to stop the discharge of ice cubes.

As set forth in more detail hereinabove, in the ice cube outlet cover assembly according to the invention, the connecting members and hinge members, which are components or elements of the cover and cover actuating lever, respectively, are made of a flexible material so as to be readily bent and straightened. Accordingly, the hinge shafts can be easily fitted in the hinge holes of the shaft supporting members formed on the inner wall of the access opening and, therefore, the installation of the cover and cover actuating lever can be readily carried out. Furthermore, because the cover and cover actuating lever can be made using conventional injection molding techniques and the shaft supporting members can also be made by such injection molding, along with the inner wall of the access opening, the assembly time and manufacturing costs associated with the ice cube outlet cover assembly of the invention are substantially reduced.

Although the invention has been described above in relation to preferred embodiments thereof, it will be understood by those skilled in the art that variations and modifications can be effected in these preferred embodiments without departing from the scope and spirit of the invention.

What is claimed is:

1. An ice cube outlet cover assembly for a refrigerator having an access opening in which an ice cube outlet is formed, said cover assembly comprising:

a cover for the ice cube outlet including a cover portion for covering the ice cube outlet and a hinge portion for hingedly mounting said cover portion in the access opening, and a cover actuating lever for moving said cover between a first position wherein the ice cube outlet is open and a second position wherein the ice cube outlet is closed, said hinge portion including connecting members extending upwardly from both sides of said cover portion, cover hinge shafts extending outwardly from upper ends of respective ones of said connecting members, a spring supporting bar extending inwardly from one of said connecting members, a cover spring mounted on said spring supporting bar for exerting a biasing force on said cover portion, and support projections extending outwardly from lower ends of said respective ones of said connecting members, and said cover actuating lever including an actuating portion having pushing bars for pushing said projections forwardly to open said ice cube outlet, a user operated tongue portion extending downwardly from said actuating portion, and hinge members extending downwardly from both sides of said actuating portion and including a spring supporting bar projecting inwardly therefrom and a lever hinge shaft projecting outwardly therefrom.

2. An ice cube outlet cover assembly according to claim 1, wherein a lever spring is mounted on said spring supporting bar for returning said cover actuating lever to an initial position thereof after termination of an ice dispensing operation.

3. An ice cube outlet cover assembly according to claim 1, wherein said spring supporting bar and lever hinge shaft are disposed on a common axis.

4. An ice cube outlet cover assembly according to claim 1, wherein shaft supporting members are disposed below the ice cube outlet so as to rotatably support respective ones of said lever hinge shafts.

5. An ice cube outlet cover assembly according to claim 2, wherein said hinge member includes a slot for fixing one end of said lever spring therein so as to prevent removal of said lever spring.

6. An ice cube outlet cover assembly according to claim 4, wherein said hinge members are of sufficient flexibility to enable said lever hinge shafts to be mounted in said shaft supporting members by deflection and release of said hinge members.

7. An ice cube outlet cover assembly for a refrigerator having an access opening in which an ice cube outlet is formed, said cover assembly comprising:

a cover for the ice cube outlet including a cover portion for covering the ice cube outlet and a hinge portion for hingedly mounting said cover portion in the access opening, and a cover actuating lever for moving said cover between a first position wherein the ice cube outlet is open and a second position wherein the ice cube outlet is closed, said hinge portion including connecting members extending upwardly from both sides of said cover portion, cover hinge shafts extending outwardly from upper ends of respective ones of said connecting members, a spring supporting bar extending inwardly from one of said connecting members, a cover spring mounted on said spring supporting bar for exerting a biasing force on said cover portion, and support projections extending outwardly from lower ends of said respective ones of said connecting members; and said assembly further comprising shaft supporting members disposed above the ice cube outlet for rotatably supporting respective ones of said cover hinge shafts.

8. An ice cube outlet cover assembly according to claim 1 wherein said connecting members are of sufficient flexibility to enable said cover hinge shafts to be mounted in said shaft supporting members by deflection and release of said connecting members.

9. An ice cube outlet cover assembly according to claim 1, wherein said spring supporting bar is disposed on a common axis with said cover hinge shafts.

10. An ice cube outlet cover assembly according to claim 7, wherein said cover actuating lever includes an actuating portion having pushing bars for pushing said projections forwardly to open said ice cube outlet, a user operated tongue portion extending downwardly from said actuating portion, and hinge members extending downwardly from both sides of said actuating portion and including a spring supporting bar projecting inwardly therefrom and a lever hinge shaft projecting outwardly therefrom.

11. An ice cube outlet cover assembly according to claim 9, wherein an end stop is disposed at a distal end of said spring supporting bar to prevent removal of said cover spring therefrom.

12. An ice cube outlet cover assembly according to claim 10, wherein a lever spring is mounted on said spring supporting bar for returning said cover actuating lever to an initial position thereof after termination of an ice dispensing operation.

13. An ice cube outlet cover assembly according to claim 10, wherein said spring supporting bar and lever hinge shaft are disposed on a common axis.

14. An ice cube outlet cover assembly according to claim 10, wherein shaft supporting members are disposed below the ice cube outlet so as to rotatably support respective ones of said lever hinge shafts.

15. An ice cube outlet cover assembly according to claim 12, wherein said hinge member includes a slot for fixing one end of said lever spring therein so as to prevent removal of said lever spring.

16. An ice cube outlet cover assembly according to claim 14, wherein said hinge members are of sufficient flexibility to enable said lever hinge shafts to be mounted in said shaft supporting members by deflection and release of said hinge members.

* * * * *